US010004349B2

(12) United States Patent
Vidal

(10) Patent No.: US 10,004,349 B2
(45) Date of Patent: Jun. 26, 2018

(54) COOLING AND STERILIZING SPOON

(71) Applicant: Jesus Daniel Vidal, Hialeah, FL (US)

(72) Inventor: Jesus Daniel Vidal, Hialeah, FL (US)

( * ) Notice: Subject to any disclaimer, the term of this patent is extended or adjusted under 35 U.S.C. 154(b) by 281 days.

(21) Appl. No.: 14/269,083

(22) Filed: May 3, 2014

(65) Prior Publication Data

US 2015/0313394 A1 Nov. 5, 2015

(51) Int. Cl.

*A47G 21/04* (2006.01)
*A47G 21/02* (2006.01)
*A47G 21/00* (2006.01)

(52) U.S. Cl.

CPC ..... *A47G 21/04* (2013.01); *A47G 21/02* (2013.01); *A47G 2021/008* (2013.01); *A47G 2400/02* (2013.01)

(58) Field of Classification Search

CPC ..... A47G 2021/008; A47G 2400/02; A47G 21/02; A47G 21/04
USPC ..... 30/142–150, 322–328
See application file for complete search history.

(56) References Cited

U.S. PATENT DOCUMENTS 929,917 A * 8/1909 Collins ..... A47G 21/04 30/324
3,235,325 A * 2/1966 Storchheim ..... A61L 9/20 422/121
3,259,132 A * 7/1966 Katter ..... A47G 21/04 30/324
3,695,110 A * 10/1972 Biolik ..... A47G 21/04 374/E1.018
4,425,711 A * 1/1984 Wood ..... A47G 21/04 30/324
4,914,819 A * 4/1990 Ash ..... A47G 21/02 30/147
5,001,608 A * 3/1991 Kehrli ..... A45D 20/12 362/19
5,115,566 A * 5/1992 Zeitlin ..... A47G 21/007 30/324
6,220,746 B1 * 4/2001 Stern ..... A47J 43/281 30/324

(Continued)

FOREIGN PATENT DOCUMENTS

DE 3741148 A1 * 6/1989

OTHER PUBLICATIONS

Brookstone®, 2013, pp. 41 and 44.*

(Continued)

*Primary Examiner* — Jason Daniel Prone
(74) *Attorney, Agent, or Firm* — Ruben Alcoba, Esq.

(57) ABSTRACT

A cooling and sterilizing spoon that generates a flow of cool air that cools a food contained within. The spoon sterilizes the flow of cool air with ultraviolet radiation prior to the air engaging the food. In this manner, contaminants that reside in the air are inactivated. This has the effect of cooling the food with a sterile source of air. The spoon integrates a fan and an ultraviolet radiation source proximally to the food to effect the cooling and sterilizing process. A concave portion contains the food. The fan and the ultraviolet radiation source are oriented towards the concave portion. A lever cover overlays the fan and the ultraviolet radiation source on the lever, and includes at least one ventilation opening for enabling air to move to and from the fan. A motor actuates the fan. A power source and a power outlet enable powering of the motor.

14 Claims, 2 Drawing Sheets

(56) References Cited

Figure 1:
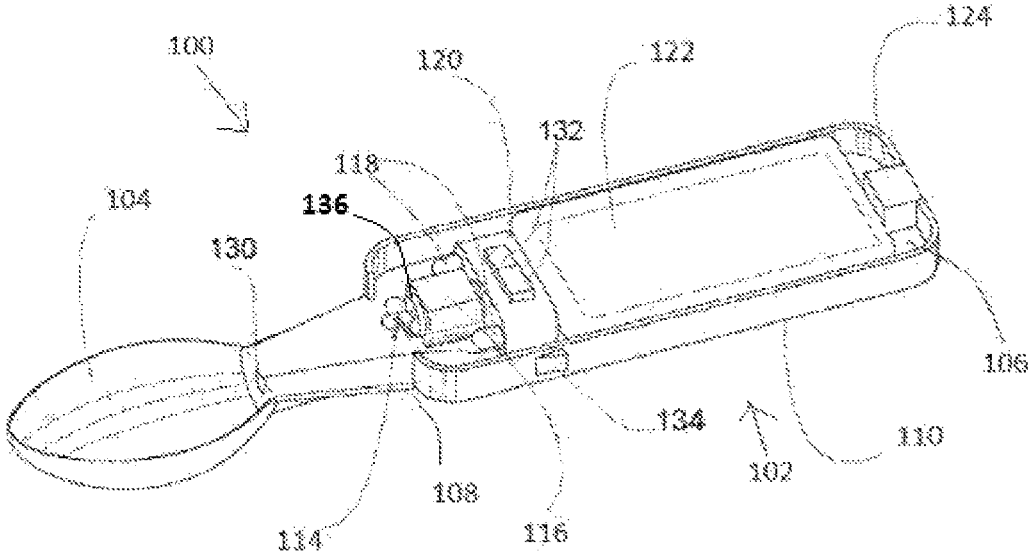

U.S. PATENT DOCUMENTS 6,239,442 B1 * 5/2001 Iimura ..... A46B 15/0002 250/453.11
6,886,255 B2 * 5/2005 Freas ..... B26B 19/06 30/200
6,915,576 B2 * 7/2005 Brzezinski ..... B26B 21/46 30/123
7,227,534 B2 * 6/2007 Lin ..... A61L 2/202 345/156
7,329,313 B2 * 2/2008 Wu ..... A61L 9/16 422/186.3
7,836,548 B2 * 11/2010 Cho ..... A47L 5/26 15/347
8,458,922 B2 * 6/2013 Parisi ..... A45D 27/48 30/538
8,747,526 B2 * 6/2014 Huang ..... F24F 3/166 96/224
8,826,489 B2 * 9/2014 Oh ..... A47L 9/0416 15/322
2005/0175512 A1 * 8/2005 Yuen ..... A61L 2/10 422/121
2006/0150819 A1 * 7/2006 Yuen ..... A61L 9/20 96/224
2007/0028453 A1 * 2/2007 Crow ..... A47G 21/02 30/147
2008/0168677 A1 * 7/2008 Miller ..... F26B 9/003 34/202
2008/0289188 A1 * 11/2008 Holdbrooks ..... A47J 43/283 30/323
2013/0192288 A1 * 8/2013 Willette ..... A61L 9/20 96/224
2014/0257173 A1 * 9/2014 Ohanessian ..... A61B 17/244 604/23
2015/0057650 A1 * 2/2015 Grosser ..... A61B 18/04 606/27
2015/0143702 A1 * 5/2015 Lepine ..... A47G 21/00 30/123
2016/0031695 A1 * 2/2016 Hecht ..... B67D 1/07 422/24
2016/0066724 A1 * 3/2016 Cowley ..... A47G 21/06 702/130
2017/0367514 A1 * 12/2017 In 'T Groen et al. A47J 27/002

OTHER PUBLICATIONS

An Inventor Asked Children to Come Up with Ideas for Inventions. Then He Made Them a Reality, Patricia Lynn, Feb. 5, 2016, pp. 8-9.*

* cited by examiner

COOLING AND STERILIZING SPOON

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

The present invention is directed to a fan spoon that cools a food contained within the spoon with a sterilized flow of cool air. A liquid food is contained within a concave portion of the spoon. A lever is arranged to join with the concave portion. The lever contains a fan that orients towards the food in the concave portion and generates a cool flow of air onto the food. The lever further comprises an ultraviolet radiation source that emits an ultraviolet radiation light on the flow of cool air to sterilize the air. In this manner, a sterile, cool flow of air is in perpetual contact with the liquid food contained in the spoon.

Typically, a spoon is a utensil consisting of a small shallow bowl, oval or round, at the end of a handle. The spoon can be a type of cutlery, especially as part of a place setting, used primarily for serving a liquid or semi-liquid food. Spoons are also used in food preparation to measure, mix, stir, and toss ingredients.

Often, a tableware spoon is used tier a soup that can often be hot. The soup can burn the tongue, esophagus, and mouth. This can have adverse effect in children and elderly people who have trouble manipulating the spoon, especially with a liquid food contained within. Blowing on the liquid food in the spoon carries the risk of disease transfer as the internal breath carries germs.

Typically, a mechanical fan is a machine used to create flow within a fluid, typically a gas such as air. The fan consists of a rotating arrangement of vanes or blades which act on the air. The rotating assembly of blades and hub is known as are impeller, a rotor, or a runner. The fan generates a high volume, low pressure flow of air. This creates a generally cool flow of air. The cool flow of air can be effective in dissipating heat from another body.

It is known that UV radiation can be an effective viricide and bactericide. Disinfection using UV radiation is commonly used in wastewater treatment applications and is finding an increased usage in drinking water treatment. Typically, the contaminants that pollute the indoor environment are almost entirely based upon organic or carbon-based compounds. These compounds break down when exposed to high-intensity UV at 240 to 280 nm. These contaminants are often found in the ambient air.

For the foregoing reasons, there is a cooling and sterilizing spoon that generates a flow of cool air on a hot liquid food contained within the spoon, and also sterilizes the flow of cool air prior to contact with the liquid food.

Spoons have been utilized in the past; yet none with the present delivery expediting characteristics of the present invention. See Patent No CN2907448; WO2001051098; and U.S. Pat. No. 599,202.

For the foregoing reasons, there is a spoon that cools liquid food with a sterilized flow of cool air.

SUMMARY

The present invention is directed to a cooling and sterilizing spoon generates a flow of cool air with a fan. The cool air contacts the surface area of the liquid food to dissipate heat therefrom, and thereby cool the liquid food contained within the spoon. The spoon also sterilizes the flow of cool air with ultraviolet radiation (UV) prior to the air engaging the food. In this manner, genus, viruses, and microorganisms that may reside in the flow of cool air are inactivated. This has the effect of cooling the food with a sterile source of cool air. In one embodiment, the spoon integrates a fan and an ultraviolet radiation source proximally to the food to effect the cooling and sterilizing process.

In one embodiment of the present invention, the cooling and sterilizing spoon for cooling food with a sterilized flow of air, comprises: a lever that has a first end configured to enable manipulation of the spoon, the lever further has a second end configured to contain operational components of the spoon; a concave portion configured to contain a food, the concave portion disposed to join with the second end of the lever; a fan configured to generate a flow of cool air over the food; and an ultraviolet radiation source configured to emit an ultraviolet light onto the flow of cool air prior to engagement with the food.

In another embodiment, the lever comprises a platform configured to support the fan and the ultraviolet radiation source.

In another embodiment, the platform defines a peripheral sidewall configured to at least partially guide the flow of cool air and the ultraviolet light towards the food.

In another embodiment, the lever comprises a motor configured to actuate the fan.

In another embodiment, the lever comprises a power source configured to power the motor.

In another embodiment, the lever comprises a power outlet configured to recharge the power source.

In another embodiment, the fan is arranged on the second end of the lever and is oriented to generate the flow of cool air directly onto the concave portion.

In another embodiment, the ultraviolet radiation source is arranged on the second end of the lever and is oriented to emit the ultraviolet directly onto the flow of cool air.

In another embodiment, the ultraviolet radiation light is a short wave radiation of about 240 to 280 nanometers.

In another embodiment, a funnel is positioned between the fan and the concave portion, the funnel is configured to at least partially guide the flow of cool air towards the concave portion.

In another embodiment, a lever cover overlays the lever, the lever cover is configured to mate with the peripheral sidewall.

In another embodiment, the lever cover has at least one ventilation opening that is configured to enable air to pass to and from the fan and the motor.

DRAWINGS

Figure 2:
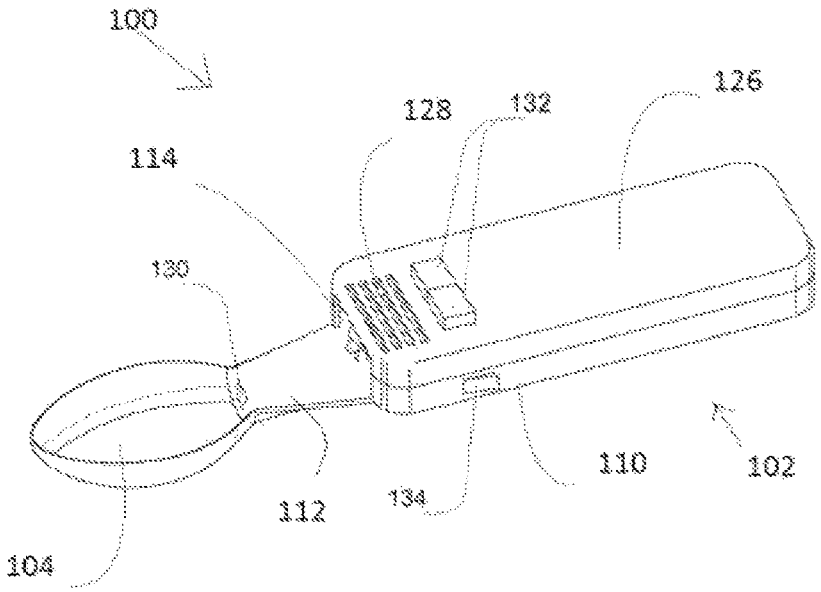

These and other features, aspects, and advantages of the present invention will become better understood with regard to the following description, appended claims, and drawings where:

FIG. 1 is a detailed perspective view of an exemplary cooling and sterilizing spoon; and FIG. 2 is a detailed perspective view of an exemplary cooling and sterilizing spoon having a fan and an ultraviolet radiation source covered with a lever cover.

DESCRIPTION

One embodiment of a cooling and sterilizing spoon 100 is illustrated in FIGS. 1-2. The spoon 100 generates a flow of cool air with a fan 114. The cool air contacts the surface area of the liquid food to dissipate heat therefrom, and thereby cool the liquid food contained within the spoon 100. The spoon 100 also sterilizes the flow of cool air with ultraviolet radiation (UV) prior to the air engaging the food. In this manner, germs, viruses, and microorganisms that may reside in the flow of cool air are inactivated. This has the effect of cooling the food with a sterile source of cool air. In one embodiment, the spoon 100 integrates a fan 114 and an ultraviolet radiation source 120 proximally to the food to effect the cooling and sterilizing process.

The spoon 100 is configured to generally contain a liquid or semi-liquid food, such as soup. However in other embodiments, the spoon 100 may also contain small, powdery solid items which cannot be easily lifted with a fork, such as rice, sugar, cereals, and green peas. Those skilled in the art will recognize that liquid foods can oft be hot. The generally small food retention area of the spoon 100 does not provide sufficient surface area exposure for the food to dissipate heat. Consequently, the liquid food remains hot for a lengthy duration. Cooling the food, and more importantly, cooling the food with a sterile flow of cool air is the function of the present invention. Suitable materials for the spoon 100 may include, without limitation, metal, flat silver, silverware, wood, porcelain, and plastic.

In some embodiments, the fan 114 is oriented on the lever 102 to face the food. The fan 114 circulates to act on the air that is proximal to the food. This creates a flow of cool air passing over the food. The constant flow of cool air passing over the food has a cooling effect on the food. In some embodiments, the lever 102 also supports an ultraviolet radiation source 120 oriented to face the food. The ultraviolet radiation source 120 emits a predetermined quantity of ultraviolet on the flow of cool air prior to the air contacting the food.

FIG. 1 references a cooling and sterilizing spoon 100. The spoon 100 comprises a lever 102 for manipulation of the spoon 100. The lever 102 may include a rigid handle efficacious for manipulation of the spoon 100. The lever is also utilized to support the integrated cooling and sterilizing components. In one embodiment, the lever 102 forms a platform that is sufficiently broad to support the fan 114, the ultraviolet radiation source 120, the motor 116, the power source 122, and the power outlet 124. A peripheral sidewall 110 extends up from the platform. The peripheral sidewall 110 helps guide the flow of cool air generated by the fan 114 to the concave portion 104. The peripheral sidewall 110 also forms a protective barrier for the fan 114, the ultraviolet radiation source 120, the motor 116, the power source 122, and the power outlet 124. The peripheral sidewall 110 also forms a surface for mating with a lever cover 126 that overlays the lever 102.

The lever 102 comprises a first end 106. The first end 106 is configured to enable manipulation of the spoon 100. The spoon 100 can be tilted and rotated by a hand that is grasping the first end 106 to capture and consume the food in the concave portion 104. The lever 102 further comprises a second end 108 configured to contain cooling and sterilizing components of the spoon 100. The second end 108 is disposed to join the concave portion 104. The second end 108 may include a power switch 134 that actuates the motor 116, which in turn powers the fan 114. The power switch 134 is operatively connected to the power source 122.

In some embodiments, the spoon 100 may include a concave portion 104 configured to contain the food. The concave portion 104 forms a bowl that is efficacious for retaining a liquid or semi-liquid food therein. The concave portion 104 disposed to join with the second end 108. In some embodiments, a funnel 112 joins the second end 108 with the concave portion 104. The funnel 112 at least partially guides the flow of cool air from the fan 114 onto the food. In some embodiments, one end of the concave portion 104 may include a temperature sensor 130 for sensing the temperature of the food. The temperature sensor 130 is operatively connected to a temperature indicator light 132 that provides a visual indication when the food is above a predetermined temperature. For example, when the soup exceeds 80° Fahrenheit, the temperature indicator light 132 illuminates in response to the temperature sensor 130. In one alternative embodiment, the temperature sensor 130 actuates the motor 116 when the predetermined temperature is exceeded.

In some embodiments, a fan 114 is arranged on the second end 108, and oriented to face the concave portion 104. The fan 114 is configured to generate a flow of cool air over the food contained within the concave portion 104. The fan 114 comprises a fan shaft 136 operatively connected to the motor. In one embodiment, the fan 114 creates flow within a fluid, typically a gas such as air. The fan 114 produces an air flows having high volume and low pressure, which generally creates a cool stream of air. The fan 114 consists of a rotating arrangement of blades which act on the air. The fan 114 is contained within the peripheral sidewall 110 of the lever 102. This arrangement may direct the flow of air and also increase safety by preventing objects from contacting the fan blades.

Turning now to FIG. 2, a motor 116 mounts on the lever 102, adjacent to the fan 114. The motor 116 serves to actuate the fan 114. The motor 116 may include an electric motor 116, but other sources of power may be used, including a solar motor, a hydraulic motor, and a gas engine. A power source 122 for powering the motor 116 positioned towards the first end 106 of the lever 102. The power source 122 may include, without limitation, a battery, a solar panel, and an external power source 122. A power outlet 124, such as an A/C socket enables an external power source 122 to recharge the battery, or power the motor 116. In one example, a miniature electric fan 114 is mounted on the spoon 100 handle and controlled by an electric switch. A rotary shaft of the fan 114 is connected with the motor 116, and the motor 116 is connected with a battery and a switch through a circuit inside the handle in series.

In some embodiments, the lever 102 further comprises a UV radiation source 120 configured to emit a UV light 118 onto the flow of cool air prior to engagement with the food. The UV radiation source 120 serves to inactivate contaminants, such as germs, viruses, and microorganisms that reside in the flow of cool air generated by the fan 114. This has the effect of cooling the food with a sterile source of air. In some embodiments, the UV radiation source 120 and the fan 114 are wired to actuate simultaneously, such that the flow of cool air generated by the fan 114 constantly receives UV light 118. It is significant to note the UV light 118 also sterilizes the surface of the lever 102 and the concave portion 104.

Those skilled in the art will recognize that the sterilizing mechanism of UV light 118 is a photochemical process. The contaminants that may pollute the flow of cool air are almost entirely based upon organic or carbon-based compounds. These compounds break down when exposed to high-intensity UV light 118 at 240 to 280 nanometers. Short-wave ultraviolet light can destroy DNA in living microorganisms and break down organic material found in indoor air. The effectiveness of the UV light 118 is directly related to intensity and exposure time. Consequently, the UV radiation source 120 positions directly behind the fan 114 to maintain a constant source of UV light 118 while the fan 114 is blowing the flow of cool air.

FIG. 1 shows the spoon 100 with a lever cover 126 overlaying the lever 102. The lever cover 126 mates with the peripheral sidewall 110 to from a protective barrier for the fan 114, the ultraviolet radiation source 120, the motor 116, the power source 122, and the power outlet 124. The lever cover 126 also inhibits external object from interfering with the blades on the fan 114. At least one ventilation opening 128 on the lever cover 126 enables air to remain in contact with the fan 114 and the motor 116. This provides air for the fan 114 to maintain the cool flow of air, and also helps cool the motor 116. The ventilation opening 128 may include, without limitations, a slot, an aperture, and a funnel 112.

While the inventor's above description contains many specificities, these should not be construed as limitations on the scope, but rather as an exemplification of several preferred embodiments thereof. Many other variations are possible. For example, the cooling and sterilizing spoon 100 could utilize an externally connected tube of flowing air, rather than a fan to generate the flow of cool air over the food. Accordingly, the scope should be determined by the embodiments illustrated, but by the appended claims and their legal equivalents.

What is claimed is:

1. A coiling and sterilizing spoon comprising a lever having a first end and a second end, the lever defining and opening adjacent the second end and an interior space in communication with the opening;

a concave portion configured to contain a food, the concave portion joined with the second end of the lever;

a fan assembly in the interior space of the lever, the fan assembly is configured to generate a flow of air over the food in the concave portion via the opening; and an ultraviolet radiation source in the interior space of the lever between the fan assembly and the first end of the lever; the ultraviolet radiation source is configured to emit an ultraviolet light onto the flow of air prior to flowing over the food in the concave portion.

2. The spoon of claim 1, wherein the lever has a platform partially defining the interior space and the platform supports the fan assembly and the ultraviolet radiation source.

3. The spoon of claim 2, wherein the lever has a peripheral sidewall defining the opening and partially defining the interior space.

4. The spoon of claim 1, wherein the ultraviolet radiation source has a pair of cylindrical lenses and the ultraviolet light is in a range from about 240 to 280 nanometers.

5. The spoon of claim 1, further comprising a motor in the interior space of the lever and the motor actuates the fan assembly.

6. The spoon of claim 5, wherein the fan assembly comprises a fan shaft operatively connected to the motor.

7. The spoon of claim 5, further comprising a power source in the interior space of the lever that powers the motor and a power switch on the second end of the lever that activates the motor.

8. The spoon of claim 7, wherein the power source is a battery.

9. The spoon of claim 5, further comprising a power outlet in the interior space of the lever and accessible through an aperture in the first end of the lever to enable recharging of the power source and/or powering the motor.

10. The spoon of claim 5, wherein the lever comprises a removable lever cover that partially defines the interior space, the lever cover has at least one ventilation opening configured to enable passage of air to the fan assembly.

11. The spoon of claim 10, wherein the at least one ventilation opening is a slit.

12. The spoon of claim 1, wherein the concave portion is a bowl.

13. The spoon of claim 1, further comprising a temperature sensor in the concave portion and configured to detect a temperature of the food in the concave portion and a temperature indicator light on the ultraviolet radiation source and extending through a hole in the lever, the temperature sensor is operatively connected to the temperature indicator light so that the temperature indicator light illuminates when the temperature sensor senses a predetermined temperature of the food in the concave portion.

14. The spoon of claim 1, wherein the lever and the concave portion are made of metal, wood, porcelain, or plastic.

* * * * *